US007316390B2

(12) United States Patent
Burlison

(10) Patent No.: US 7,316,390 B2
(45) Date of Patent: Jan. 8, 2008

(54) CONDUIT CLAMPING DEVICE

(76) Inventor: Aaron Burlison, 7921 Apache La., Woodridge, IL (US) 60517

( * ) Notice: Subject to any disclaimer, the term of this patent is extended or adjusted under 35 U.S.C. 154(b) by 42 days.

(21) Appl. No.: 11/254,890

(22) Filed: Oct. 20, 2005

(65) Prior Publication Data

US 2007/0090581 A1 Apr. 26, 2007

(51) Int. Cl.
*B25B 1/24* (2006.01)

(52) U.S. Cl. ..... 269/274; 269/903

(58) Field of Classification Search ..... 269/239, 269/228, 903, 268, 50; 248/68.1, 74.3
See application file for complete search history.

(56) References Cited

U.S. PATENT DOCUMENTS

| | | | | |
|---|---|---|---|---|
| 817,513 | A | 4/1906 | Parker | |
| 960,916 | A | 6/1910 | Heiser | |
| 1,225,981 | A | 5/1917 | Loughridge | |
| 1,740,863 | A | 12/1929 | Krause | |
| 1,798,340 | A | 3/1931 | Thewes | |
| 2,381,584 | A | 8/1945 | Fulleton | |
| 2,404,531 | A * | 7/1946 | Robertson | 248/68.1 |
| 2,619,858 | A | 12/1952 | Starbuck et al. | |
| 2,709,384 | A | 5/1955 | Harris | |
| 2,848,785 | A | 8/1958 | Bachli et al. | |
| 2,932,995 | A | 4/1960 | Durfee | |
| 4,005,945 | A | 2/1977 | Gutman | |
| 4,079,927 | A * | 3/1978 | Rocton | 269/296 |
| 4,108,589 | A * | 8/1978 | Bunch | 425/393 |
| 4,415,149 | A | 11/1983 | Rees | |
| 4,579,322 | A | 4/1986 | Schwarz | |
| 4,623,156 | A * | 11/1986 | Moisson et al. | 279/106 |
| 4,775,121 | A * | 10/1988 | Carty | 248/68.1 |
| 5,207,252 | A | 5/1993 | Risse | |
| 5,299,656 | A * | 4/1994 | Grill | 182/186.4 |
| 5,302,058 | A | 4/1994 | Bishop | |
| 5,613,655 | A * | 3/1997 | Marion | 248/68.1 |
| 5,727,779 | A | 3/1998 | Ramoski | |
| 5,992,802 | A * | 11/1999 | Campbell | 248/68.1 |
| 6,003,851 | A * | 12/1999 | Araki et al. | 269/239 |
| 6,554,265 | B2 | 4/2003 | Andronica | |
| 7,165,703 | B1 * | 1/2007 | Howe | 224/406 |
| 2004/0065989 | A1 | 4/2004 | Campbell | |

FOREIGN PATENT DOCUMENTS

| | | |
|---|---|---|
| GB | 1989/2210823 | 6/1989 |
| GB | 1995/2286144 | 8/1995 |
| JP | 1998/10076423 | 3/1998 |

* cited by examiner

*Primary Examiner*—Lee D Wilson
(74) *Attorney, Agent, or Firm*—Beem Patent Law Firm

(57) ABSTRACT

A conduit clamping device has an elongated substantially rigid base having a longitudinal axis. At least one axially extending elongated generally U-shaped channel is formed in the base and sized to receive at least a portion of a length of conduit of a given diameter. A lid is hingedly coupled to the base and relatively hingedly movable between an open position for permitting conduit to be placed in or removed from the channel and a closed position for grippingly engaging the conduit between the lid and the channel. A quantity of resilient material is mounted to at least one of the lid and the channel for resiliently, grippingly engaging the conduit when the lid is in the closed position.

18 Claims, 6 Drawing Sheets

20
24
25
26
27
28
29
34
43

CONDUIT CLAMPING DEVICE

BACKGROUND OF THE INVENTION

1. Field of the Invention

The present invention is directed to tools such as clamps, vises, and jigs and, more particularly, to a conduit clamping device.

2. Description of the Related Art

Building codes commonly require that when installing 110 VAC household electrical wiring, the conductors are to be pulled through a grounded, electrically conductive metal tubing known as conduit or EMT. Typically, during construction, the conduit must be cut to various lengths, and sometimes bent at various angles in order to direct the wiring to and among desired locations. Such conduit is commonly fabricated from aluminum, steel, or the like in a variety of diameters depending on the number of conductors or wires to be pulled through the conduit. For example, conduit is typically provided in diameters of one half inch, three-quarter inch and one inch, although other sizes are possible.

Typically, electricians use a manual hacksaw, or powered reciprocating or circular saw to cut the conduit to the desired length prior to installation. The cutting operation may be performed before and/or after any needed bending operation. Often, the electrician holds the conduit on any convenient surface for support during cutting e.g., a pail, ladder, or the floor, or even his or her knee, in an effort to hold the conduit steady.

It is possible to hold the conduit in a carpenter's vise or the like, if one is available at the work site. Moreover, the traditionally flat opposed surfaces of conventional vise may allow the conduit to rotate during the cutting operation. If the vise jaws are further tightened in an effort to hold the conduit motionless, they may crush or deform or otherwise damage the conduit.

BRIEF SUMMARY OF THE INVENTION

In accordance with one aspect of the invention, a conduit clamping device, comprises an elongated substantially rigid base having a longitudinal axis; at least one axially extending elongated generally U-shaped channel formed in the base and sized to receive at least a portion of a length of conduit of a given diameter therein; a lid hingedly coupled to the base and relatively hingedly movable between a first open position for permitting conduit to be placed in or removed from the channel and a second closed position for grippingly engaging the conduit between the lid and the channel; a quantity of resilient material mounted to at least one of the lid and the channel for resiliently, grippingly engaging the conduit when the lid is in the closed position.

In accordance with another aspect of the invention, method of securing conduit, comprises providing a conduit clamping device, comprising an elongated substantially rigid base having a longitudinal axis; at least one axially extending elongated generally U-shaped channel formed in the base and sized to receive at least a portion of a length of conduit of a given diameter therein; a lid hingedly coupled to the base and relatively hingedly movable between a first open position for permitting conduit to be placed in or removed from the channel and a second closed position for grippingly engaging the conduit between the lid and the channel; a quantity of resilient material mounted to at least one of the lid and the channel for resiliently, grippingly engaging the conduit when the lid is the closed position; moving the lid to the open position; placing a length of conduit in the channel, and moving the lid to the closed position.

These and other aspects and features of the invention will become more apparent upon reading the following detailed description when taken in conjunction with the accompanying drawings.

DETAILED DESCRIPTION

Figure 1:
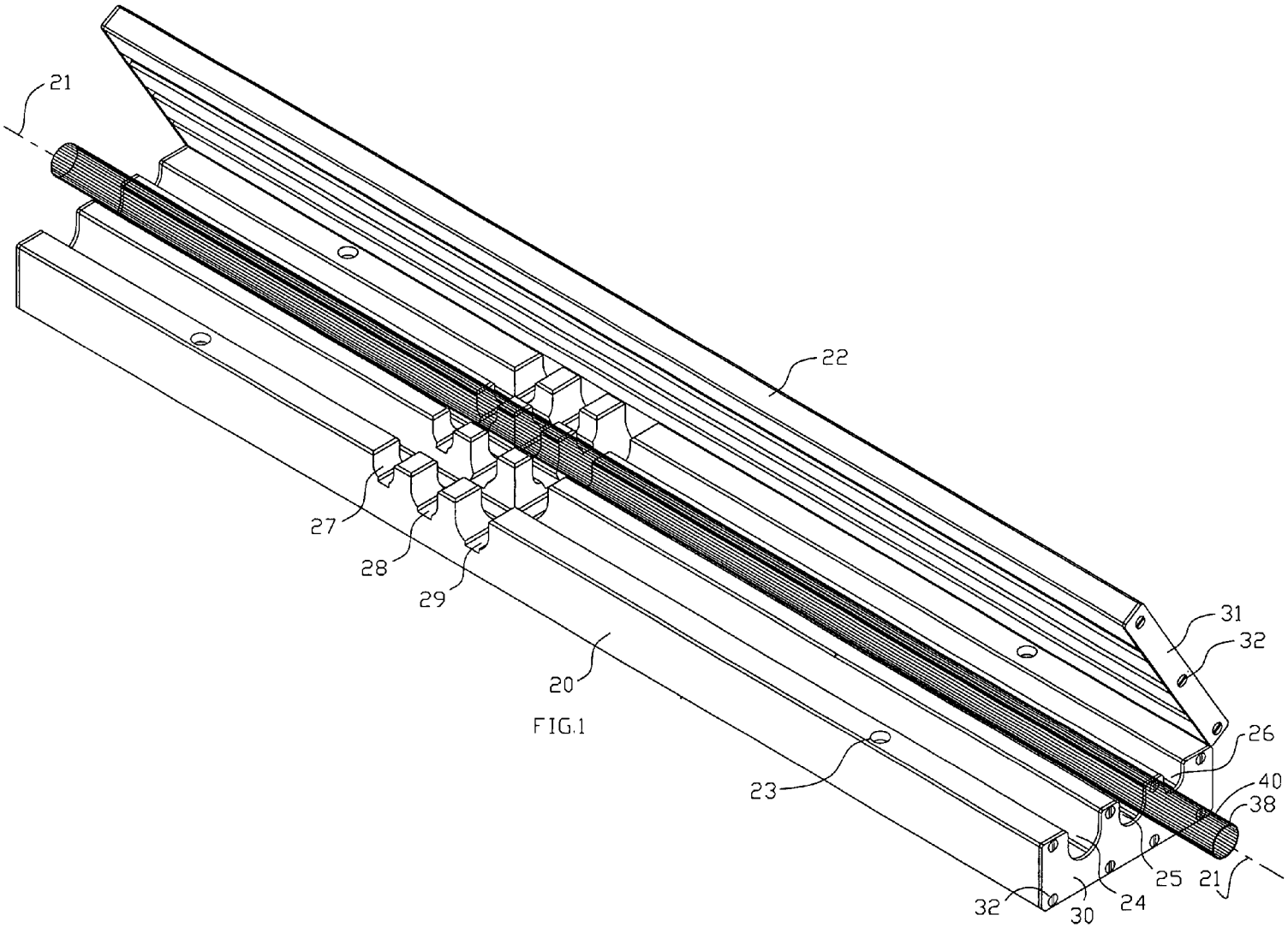
FIG. 1 is an isometric view of a conduit clamping device in accordance with one aspect of the invention.
Figure 4:
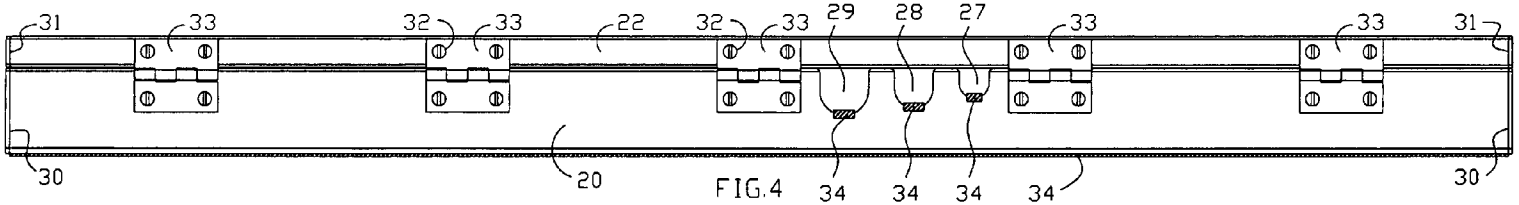
FIG. 4 is an assembly back view thereof
Figure 2:
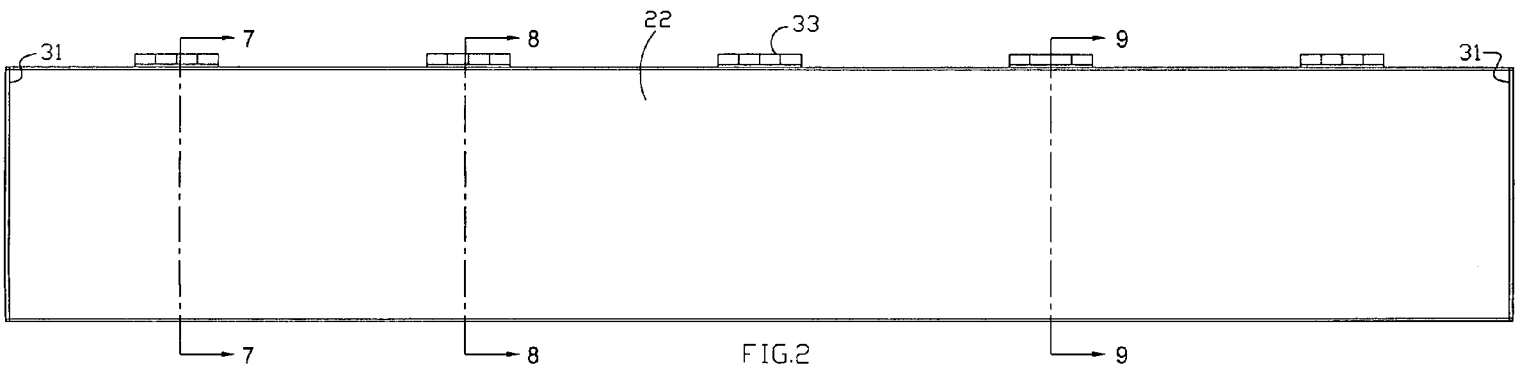
FIG. 2 is an assembly top view of the conduit clamping device of FIG. 1.
Figure 3:
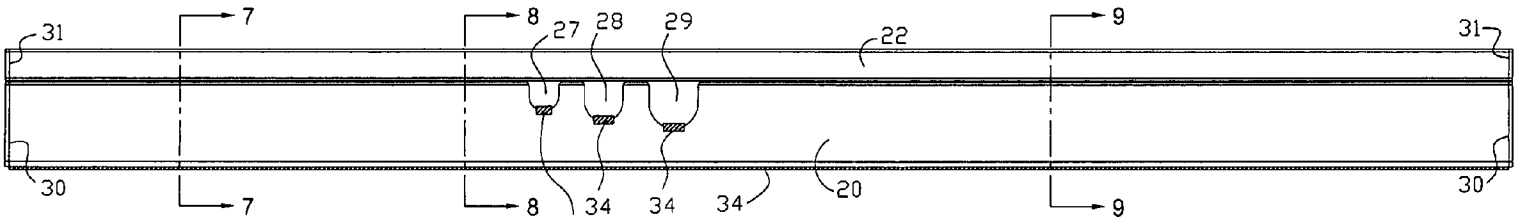
FIG. 3 is an assembly front view thereof.
Figure 5:
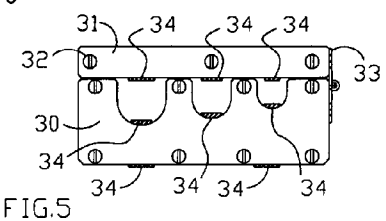
FIG. 5 is an assembly right side view thereof
Figure 6:
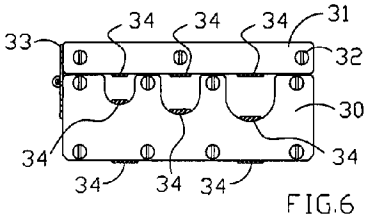
FIG. 6 is an assembly left side view thereof
Figure 7:
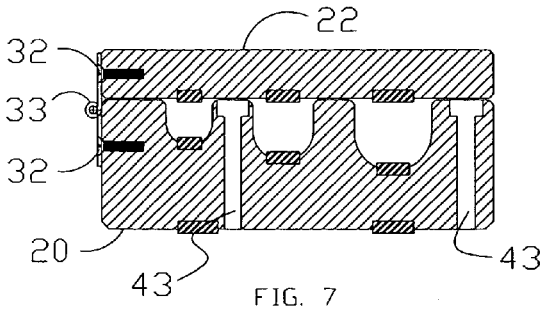
FIG. 7 is an assembly section view taken generally along the line 7-7 of FIGS. 2 and 3.
Figure 8:
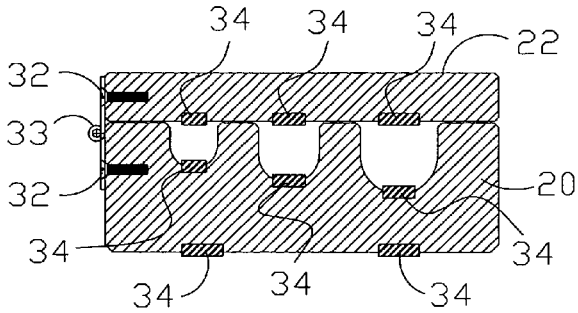
FIG. 8 is an assembly section view taken generally along the line 8-8 of FIGS. 2 and 3.
Figure 9:
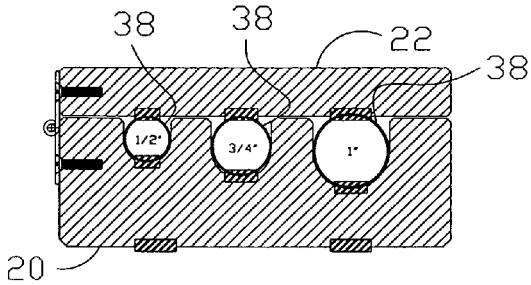
FIG. 9 is an assembly section view taken generally along the line 9-9 of FIGS. 2 and 3; and showing ½", ¾" and 1" electrical conduit.

Referring to FIG. 1, there is shown a conduit clamping device in accordance with one aspect of the invention. The conduit clamping device has an elongated substantially rigid base or body portion 20 having a longitudinal axis 21. At least one axially extending elongated generally U-shaped channel (in the illustrated embodiment, three channels 24, 25, 26) is formed in the base and sized to receive at least a portion of a length of conduit, e.g., 38, of a given diameter therein. A lid 22 is hingedly coupled to the base 20 and relatively hingedly movable between a first or open position, shown in FIG. 1, for permitting conduit to be placed in or removed from the channel 24, 25 or 26 and a second or closed position (as shown in FIGS. 7-9) for grippingly engaging the conduit between the lid 22 and the channel.

Referring also to FIGS. 2-7, to further enhance the secure engagement of the conduit, a quantity of resilient material 34, such as neoprene may be mounted to at least one of the lid 22 and the bottom of each channel for resiliently, grippingly engaging the conduit when the lid is the closed position. The elongated, generally U-shaped channels 24, 25, 26 formed in the base 20, may each be sized to receive at least a portion of a length of conduit of a given diameter different from the diameter of conduit for which each other one of the plurality of channels 24, 25, 26 is sized. In the illustrated embodiment, the channel 26 is sized to receive conduit having a diameter of one-half inch, the channel 25 is sized to receive conduit having a diameter of three-quarters inch, and the channel 24 is sized to receive conduit having a diameter of one inch. Accordingly, each channel has a width at least as great as the diameter of the conduit which it is sized to receive and preferably somewhat greater so as to achieve a non-interference fit. Fewer or more channels may be provided without departing from the invention.

In the illustrated embodiment, the base 20 is rectilinear having a length defining the longitudinal axis 21 and a width less than and substantially normal to the length. The lid 22 is sized and is coupled to the base in a position for engaging at least an outer end portion of a length of conduit 38, received in one of the channels when the lid is in the closed position. This holds the conduit 38 so that it may be cut in an area 40 close to the outer end of the base 20.

The base 20 may be of a width sufficient to accommodate at least one channel and may be wider to accommodate two channels, or, as illustrated, three channels, that is, from about 2 in. wide to about 6 in. wide. The length of the base 20 and the channel or channels should be sufficient to secure a substantial length of conduit in place, while cutting in the area 40 adjacent the end of the base, that is, from about 1 ft. to about 3 ft. Similarly, the dimensions of the lid 22 and the location(s) of its hinged connection to the base 20 should be such as to permit application of substantial force upon the lid when in the closed position for gripping the conduit 38 securely during the cutting operation. It is contemplated that electrician or other user will apply pressure to the lid by suitable means such as a hand, knee, or the like during the cutting operation in order to securely grip the conduit 38. In illustrated embodiment, the lid 22 is also rectilinear having substantially the same length and width as a base 20.

The base 20 and 22 may be formed from wood or other suitable formable material. In the illustrated embodiment, respective end plates 30 and 31, which may be formed of a metal, such as steel, are provided at either end of the base 20 and 22, respectively. These end plates 30 and 31 may be secured by suitable fasteners 32 or other attachment means. The base 20 and lid 22 for the above-described hinged movement by a plurality of spaced apart hinges 33 along the length of one side thereof and attached to the base 20 and the lid 22 by fasteners 32 or other suitable attachment means.

At least one, and in the illustrated embodiment, three U-shaped channels 27, 28 and 29 are formed in the base extending across a width dimension of the base and intersecting the elongated U-shaped channels 24, 25 and 26. Channels 27, 28 and 29 are sized to receive at least a portion of a length of conduit, e.g., 38, of a given diameter therein, and, as with channels 24, 25, 26, may each be sized to receive at least a portion of a length of conduit of a given diameter different from the diameter of conduit for which each other one of channels 27, 28, 29 is sized. In the illustrated embodiment, the channel 27 is sized to receive conduit having a diameter of one-half inch, the channel 28 is sized to receive conduit having a diameter of three-quarters inch, and the channel 29 is sized to receive conduit having a diameter of one inch. Accordingly, each channel has a width at least as great as the diameter of the conduit which it is sized to receive and preferably somewhat greater so as to achieve a non-interference fit. Fewer or more such channels may be provided without departing from the invention.

The channels 27, 28 and 29 are provided to accommodate a situation wherein a length of conduit is to be cut at a point relatively closely spaced from a bend which has previously been formed therein.

In the illustrated embodiment, resilient material 34 has been provided as a plurality of elongated strips of neoprene material, which are secured generally along the bottoms of each of the U-shaped channels 24, 25, 26 and also of each of channels 27, 20, 29, e.g. by an adhesive. Collaboratively, similar strips of resilient material may be adhesively or otherwise affixed to an undersurface of the lid 22 and located so as to be generally coaxially facing each of the channels 24, 25 and 26 when the lid is in the closed position. For a more complete view of the above described strips of resilient material 34, reference is invited to FIGS. 8 through 22. As shown in these figures, two additional strips of resilient material 34, may also be adhesively or otherwise secured to a bottom surface of the base 20 in order to provide a non-sliding engagement with a support surface (not shown) upon which the cable clamping device may be placed.

As shown in the drawings, shallow grooves may be formed in the channels, base and lid for accommodating the neoprene strips. In the embodiment shown, the neoprene strips are from about ⅛ inch to about ¼ inch thick and from about ¼ inch to about 1 inch wide, and extend about the full length of the base and top. The width of each of the neoprene strips may be selected so as to readily interfit in the channel or location on the lid opposite the channel for which that particular strip is intended. The neoprene strips on the base may be of any desired width, and are shown about ¾ inch wide.

Four through bores 43 in the base 20 are also illustrated in FIGS. 7 and 13-16. These through bores are provided for receiving suitable fasteners (not shown) for securely mounting the cable clamping device some other support member or support surface while in use.

Figure 23:
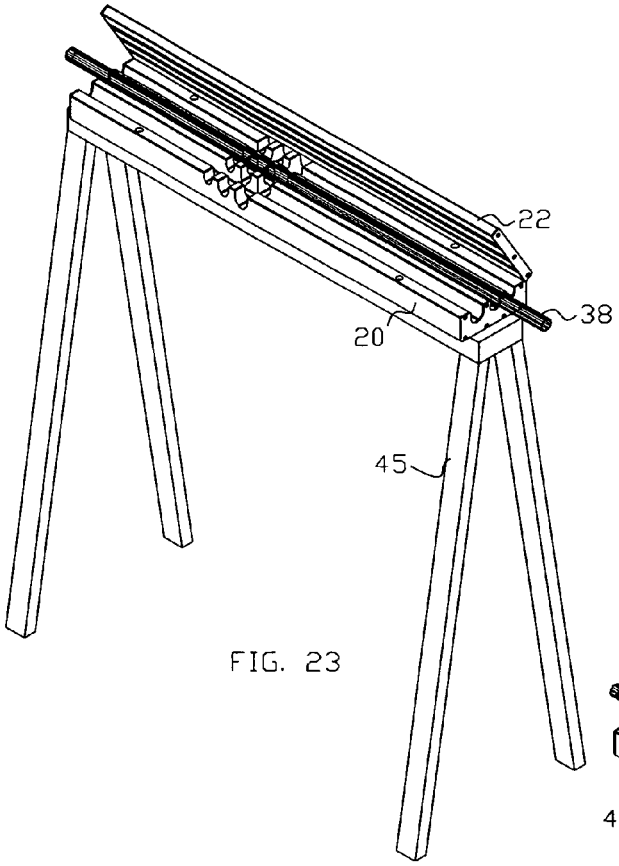
FIG. 23 is an isometric view of a conduit clamping device in accordance with one aspect of the invention mounted on saw horse-like stand.
Figure 24:
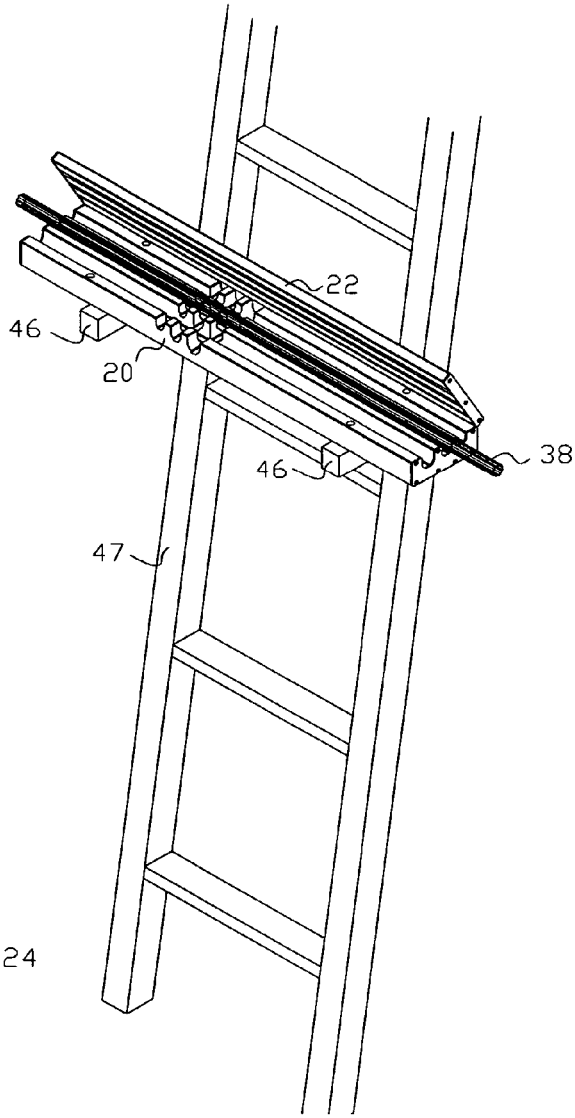
FIG. 24 is an isometric view of a conduit clamping device in accordance with one aspect of the invention mounted on ladder.

In this regard, and referring to FIGS. 23 and 24, two such mounting arrangements are shown. It will be understood that the invention is not limited to the arrangements shown but rather, other mounting arrangements may be used without departing from the invention. In FIG. 23, a sawhorse-type of support 45 is shown. The base 20 may be mounted to the sawhorse 45 by means of suitable fasteners engaged with the through bores 43 of the base 20, described above. In similar fashion, referring to FIG. 24, for mounting to a ladder 47 or similar member, a pair of cross members 46 may be suitably affixed to the ladder, and the base 20 of the cable clamping device mounted thereto utilizing fasteners engaged with the through bores 43 of the base 20, as illustrated. A latch may be provided to secure the lid in the closed position, for use in storage and transport of the conduit clamping device.

Figure 10:
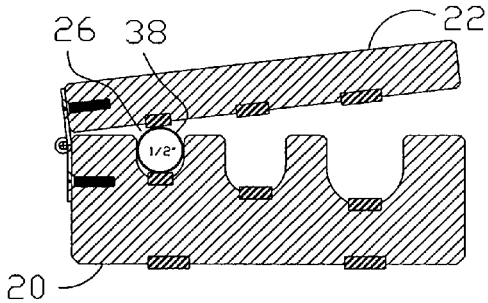
FIG. 10 is an assembly section view similar to FIG. 9, and showing ½" electrical conduit and the lid less than fully closed.
Figure 11:
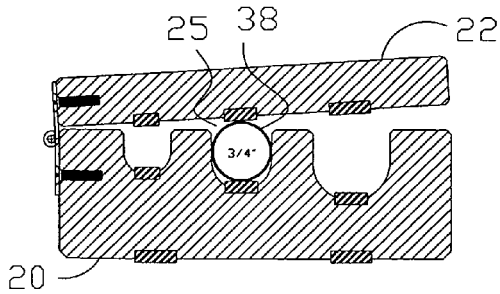
FIG. 11 is an assembly section view similar to FIG. 9, and showing ¾" electrical conduit and the lid less than fully closed.
Figure 12:
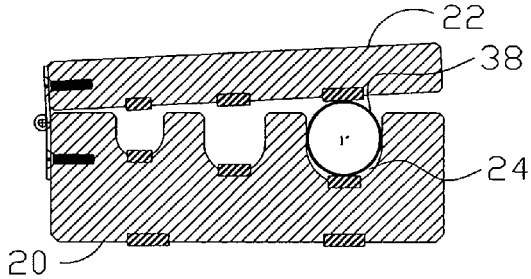
FIG. 12 is an assembly section view similar to FIG. 9, and showing 1" electrical conduit and the lid less than fully closed.
Figures 13, 14, 15, 16, 17:
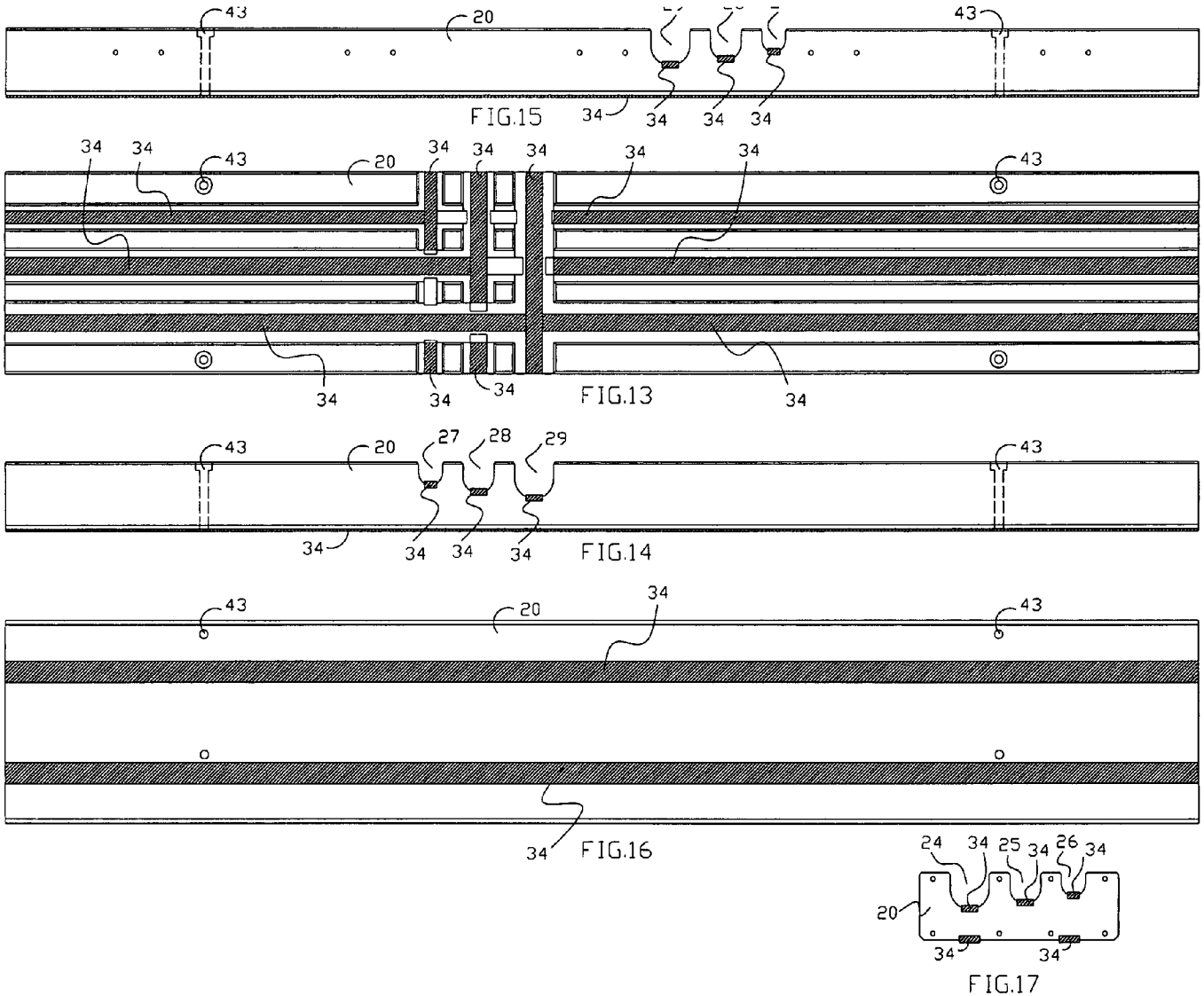
FIG. 13 is a top view of a base or body portion of the conduit clamping device of FIG. 1.
FIG. 14 is a front view of the base or body portion.
FIG. 15 is a back view of the base or body portion.
FIG. 16 is a bottom view of the base or body portion.
FIG. 17 is a right side view of the base or body portion.
Figure 21:
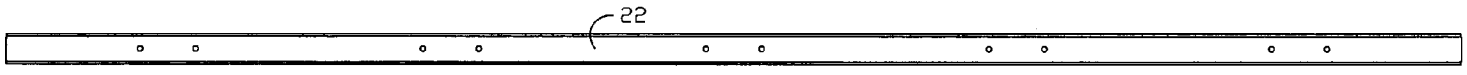
FIG. 21 is a bottom view of the lid portion
Figure 18:
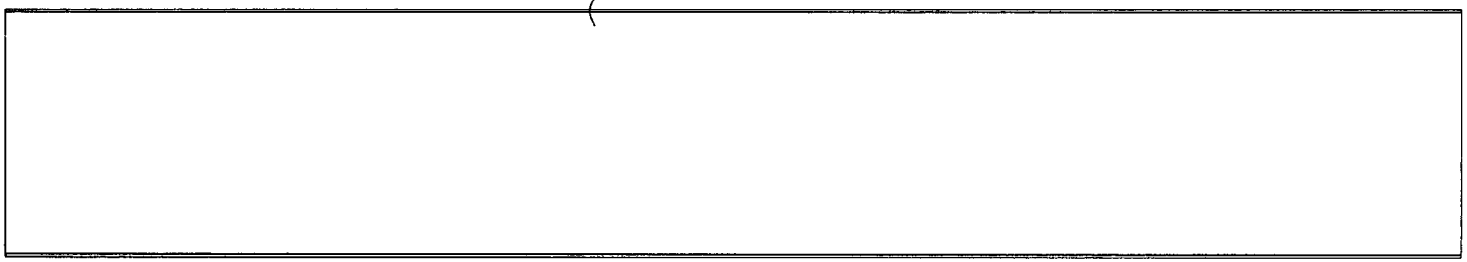
FIG. 18 is a top view of a lid portion of the conduit clamping device of FIG. 1.
Figure 19:
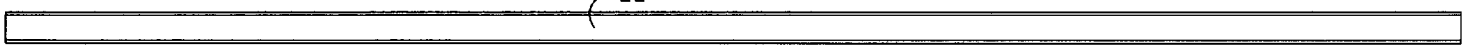
FIG. 19 is a front view of the lid portion.
Figure 20:
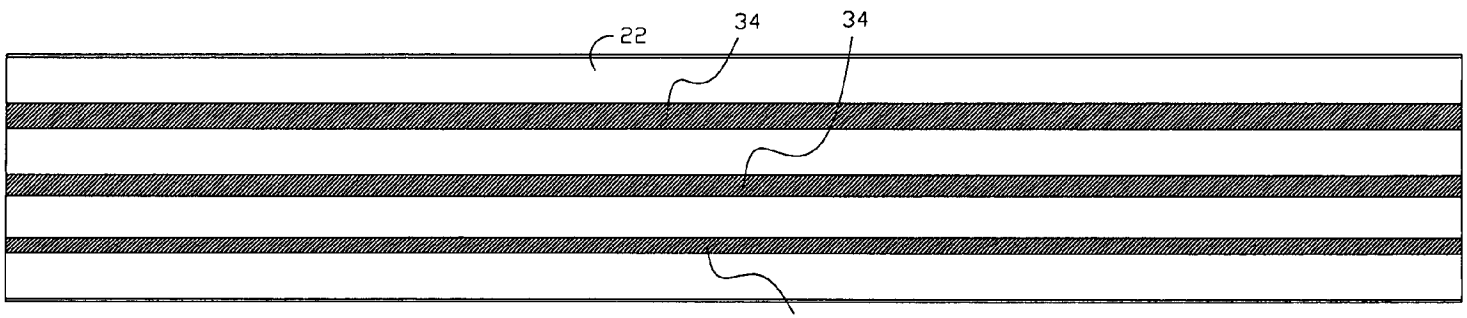
FIG. 20 is a back view of the lid portion
Figure 22:
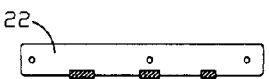
FIG. 22 is a is a right side view of the lid portion

FIGS. 9 through 12 illustrated in cross-section, the conduit clamping device with its U-shaped channels 24, 25 and 26 occupied by three different sizes of conduits simultaneously (FIG. 9), and individually, as shown FIGS. 10 through 12. Each of FIGS. 10 through 12 shows the lid 22 in only a partially closed position relative to the base 20, whereas FIG. 9 shows the lid 22 in a fully closed position. As a practical matter, it is not contemplated that the conduit clamping device will be used for holding more than one length of conduit at a time; however FIG. 9 shows three different sizes of conduit, one-half inch, three-quarter inch and one inch, in relation to the complementary sized U-shaped channels 24, 25 and 26 in the base 20.

The invention also extends to a method of securing conduit, which method comprises providing a conduit clamping device which has an elongated substantially rigid base 20 having a longitudinal axis 21, at least one axially extending elongated generally U-shaped channel 24, 25 and/or 26 formed in the base 20 and sized to receive at least a portion of a length of conduit 38 of a given diameter therein, a lid 22 hingedly coupled to the base 20 and relatively hingedly movable between a first open position for permitting conduit to be placed in or removed from the channel and a second closed position for grippingly engaging the conduit between the lid and the channel and a quantity of resilient material 34 mounted to at least one of the lid 22 and the channel 24, 25 and/or 26 for resiliently, grippingly engaging the conduit 38 when the lid 22 is the closed position. The method includes moving the lid to the open position, placing a length of conduit in the channel, and moving the lid to the closed position.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. A conduit clamping device, comprising:

an elongated substantially rigid base having a length, an axis along said length, and a width less than and substantially normal to said length; at least one elongated generally U-shaped channel formed in said base and sized to receive at least a portion of a length of conduit of a given diameter therein, wherein said at least one elongated generally U-shaped channel extends along said axis; a lid hingedly coupled to said base wherein at least one channel is substantially perpendicular to said U-shaped channel, and relatively hingedly movable between a first open position for permitting conduit to be placed in or removed from said channel and a second closed position for grippingly engaging said conduit between said lid and said channel; a quantity of resilient material mounted to at least one of said lid and said channel for resiliently, grippingly engaging said conduit when said lid is said closed position.

2. The device of claim 1, and further including a plurality of elongated, generally U-shaped channels formed in said base, wherein each one of said plurality of channels is generally parallel to said axis, and wherein each one of said plurality of channels is a different size.

3. The device of claim 2, wherein said lid is sized and is coupled to said base in a position for engaging at least an outer end portion of a length of conduit received in any of said channels when said lid is in said closed position.

4. The device of claim 2, wherein said plurality of channels include at least one channel sized to receive conduit having a diameter of one-half inch, at least one channel sized to receive conduit having a diameter of three-quarters inch, and at least one channel sized to receive conduit having a diameter of one inch.

5. A device according to claim 4, wherein said quantity of resilient material comprises an elongated strip of resilient material secured within each said U-shaped channel and extending over a major fractional portion of said length thereof.

6. A device according to claim 5 wherein said quantity of resilient material comprises a plurality of elongated strips of resilient material secured to the lid, each positioned for alignment with one of said U-shaped channels when said lid is in said closed position.

7. The device of claim 2, wherein each one of said plurality of channels has a width at least as great as a diameter of conduit to be received therein.

8. The device of claim 1, wherein said lid is sized and is coupled to said base in a position for engaging at least an outer end portion of a length of conduit received in said channel when said lid is in said closed position.

9. The device of claim 1, wherein said channel has a width at least as great as a diameter of said conduit.

10. The device of claim 1, further including a stand and means for mounting said base to said stand.

11. A device according to claim 10 wherein said stand is a sawhorse.

12. The device of claim 1, and further including at least one generally U-shaped channel extending across said width of said base and intersecting said at least one elongated U-shaped channel.

13. A device according to claim 1, wherein said quantity of resilient material comprises an elongated strip of resilient material secured within said U-shaped channel and extending over a major fractional portion of said length thereof.

14. A device according to claim 13 wherein said quantity of resilient material comprises an elongated strip of resilient material secured to the lid and positioned for alignment with said U-shaped channel when said lid is in said closed position.

15. A device according to claim 1 and further including latching means for releasably latching said lid in said closed position.

16. A device according to claim 1 wherein said length is between about 1 foot and about 3 feet.

17. A device according to claim 1 wherein said base is made from wood.

18. A method of securing conduit, comprising:

providing a conduit clamping device, comprising an elongated substantially rigid base having a length, an axis along said length, and a width less than and substantially normal to said length; at least one elongated generally U-shaped channel formed in said base and sized to receive at least a portion of a length of conduit of a given diameter therein, wherein said at least one elongated generally U-shaped channel extends along said axis; a lid hingedly couple to said base and relatively hingedly movable between a first open position for permitting conduit to be placed in or removed from said channel and a second closed position for grippingly engaging said conduit between said lid and said channel; a quantity of resilient material mounted to at least one of said lid and said channel for resiliently, grippingly engaging said conduit when said lid is said closed position; moving said lid to said open position; placing a length of conduit in said channel, and moving said lid to the closed position.

* * * * *